US005960979A

United States Patent [19]

Van Den Brink et al.

[11] Patent Number: 5,960,979

[45] Date of Patent: Oct. 5, 1999

[54] PLASTIC BUCKET WITH LID AND SEALING LIP

[75] Inventors: Anno Gerrit Van Den Brink, Otterlo; Dirk Steven Van Den Brink, Barneveld, both of Netherlands

[73] Assignee: Van den Brink B.V., Harskamp, Netherlands

[21] Appl. No.: 09/013,493

[22] Filed: Jan. 26, 1998

[51] Int. Cl.[6] ..... B65D 41/32

[52] U.S. Cl. ..... 220/266; 220/780; 220/793

[58] Field of Search ..... 220/266, 268, 220/276, 780, 782, 784, 786, 788, 793, 756, 771

[56] References Cited

U.S. PATENT DOCUMENTS

| | | | |
|---|---|---|---|
| 5,027,969 | 7/1991 | Lesquir | 220/266 X |
| 5,224,617 | 7/1993 | Gaudreault | 220/266 |
| 5,303,839 | 4/1994 | Blumenschein | 220/266 X |
| 5,307,948 | 5/1994 | Blackburn et al. | 220/268 X |
| 5,411,160 | 5/1995 | Goulet et al. | 220/780 X |
| 5,437,386 | 8/1995 | Von Holdt | 220/268 X |
| 5,785,203 | 7/1998 | Arshinoff et al. | 220/266 X |

FOREIGN PATENT DOCUMENTS

| | | |
|---|---|---|
| 4306976 | 9/1994 | Germany . |
| 4422534 | 8/1995 | Germany . |

*Primary Examiner*—Stephen K. Cronin
*Assistant Examiner*—Nathan Newhouse
*Attorney, Agent, or Firm*—Welsh & Katz, Ltd.

[57] ABSTRACT

Plastic bucket provided with a lid, the bucket having a single upper edge, a circumferential rib, and a depending edge connecting to the circumferential rib, the circumferential rib and the depending edge having such a profile that in sealed condition gripping the free lower edge of the lid is impossible. After removal of the sealing lip, gripping the free lower edge of the lid at the sealing position is possible in that the shape of the circumferential rib, and the depending edge connecting thereto, at the sealing position deviates from the shape thereof at the other circumferential positions, this deviating shape, however, in each case being such that the circumferential rib, throughout the circumference and hence also at the sealing position, extends adjacent to the upper edge of the bucket, so that the stiffness of the bucket is substantially the same throughout the circumference thereof.

8 Claims, 7 Drawing Sheets

C
C
5
8
11
12
13
9
7
7a
4

C
5
8
8
11
12
13
13

11
13
13
9
8
9
C 12
7
7a
11
13
9
8
5
4

5
8
9
11
12
13
C
15
16
17
4

C
C
5
8
9
11
12
13
14
15
16
17
4

PLASTIC BUCKET WITH LID AND SEALING LIP

BACKGROUND OF THE INVENTION

This invention relates to a plastic bucket provided with a lid, the bucket comprising a bottom wall and at least one sidewall, which sidewall terminates at an upper side of the bucket in a single upper edge, the lid comprising a top wall and a depending circumferential apron by means of which the lid is clampable onto the single upper edge, the bucket comprising adjacent the upper edge a circumferential rib extending substantially perpendicularly to the bucket, which circumferential rib merges into a depending edge extending substantially parallel to the sidewall, the circumferential rib and the depending edge connecting thereto being provided with a profile to which connects a free lower edge of the depending circumferential apron of the lid, in a closed position of the lid, such that the free lower edge is not grippable for a user, the bucket comprising a removable sealing lip which is located adjacent the circumferential rib and the depending edge connecting thereto, at a sealing position, the sealing lip in a sealed condition preventing gripping of the free lower edge of the lid, while after removal of the sealing lip the gripping of the free lower edge of the lid at the sealing position is possible.

DESCRIPTION OF THE RELATED ART

Such a bucket is known from German "Offenlegungsschrift" 43 06 976.

A drawback of the known bucket, however, is that at the sealing position it is considerably less stiff than elsewhere at the circumference. This is a consequence of the fact that the circumferential rib is situated considerably lower at the location of the sealing position than it is at the other circumferential parts. Because, moreover, the depending edge connecting to the circumferential rib has a rather small height, the bracing connection between the circumferential rib and the depending edge at the sealing position and the circumferential rib and the depending edge at the other circumferential areas is minimal, as a result of which the bucket buckles easily at the sealing position.

BRIEF SUMMARY OF THE INVENTION

The object of the invention is to provide a bucket of the type described in the preamble without the above-described disadvantages, that is, a bucket, provided with a lid, with a single upper edge and a sealing lip and having a stiffness substantially the same throughout the circumference.

Gripping the free lower edge of the lid at the sealing position upon removal of the sealing lip is possible in that the bucket of the type mentioned in the preamble is characterized, according to the invention, in that the shape of the circumferential rib and the depending edge connecting thereto at the sealing position deviates from the shape thereof at the other circumferential positions, this deviating shape, however, being such in each case that the circumferential rib, throughout the circumference and hence also at the sealing position, extends adjacent the upper edge of the bucket, in such a manner that the stiffness of the bucket is substantially the same throughout the circumference thereof.

Because also after removal of the sealing lip a large part of the circumferential rib, and preferably also a large part of the depending edge, remain present at the sealing position and because these parts which remain behind are situated substantially at the same height relative to the upper edge and at the same distance from the sidewall, the bucket has a particularly good stiffness along the entire circumference.

BRIEF DESCRIPTION OF THE SEVERAL VIEWS OF THE DRAWINGS

Further elaborations of the invention are described in the subclaims and will be further clarified below on the basis of a number of exemplary embodiments, with reference to the drawings.

DETAILED DESCRIPTION OF THE INVENTION

Figure 1:
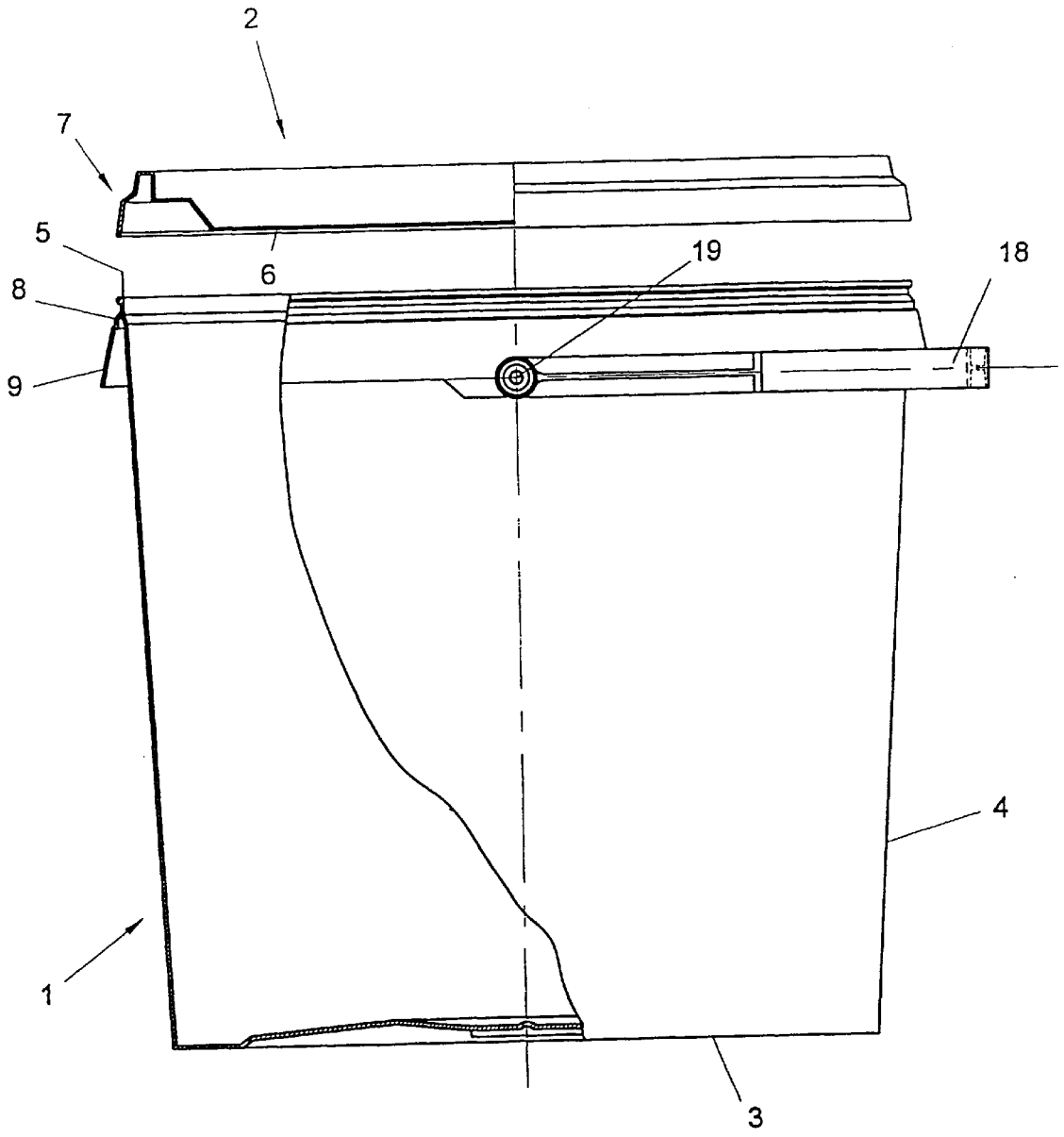
FIG. 1 shows a perspective elevation of a bucket.

FIG. 1 shows an example of a plastic bucket 1 to which the present invention relates. The plastic bucket 1 comprises a bottom wall 3 and at least one sidewall 4, which sidewall 4 terminates at an upper side of the bucket in a single upper edge 5. The bucket 1 is further provided with a lid 2 with a top wall 6 and a depending circumferential apron 7 by means of which the lid 2 is clampable onto the single upper edge 5. The bucket 1 comprises adjacent the upper edge 5 a circumferential rib 8 extending substantially perpendicularly to the bucket 1, which merges into a depending edge 9 extending substantially parallel to the sidewall 4. The circumferential rib 8 and the depending edge 9 connecting thereto are provided with a profile to which connects a free lower edge 7*a* of the depending circumferential apron 7 of the lid 2, in a closed position of the lid 2, such that the free lower edge 7*a* is not grippable for a user. The bucket 1 further comprises a removable sealing lip 11 which is located adjacent the circumferential rib 8 and the depending edge 9 connecting thereto, at a sealing position 12. The sealing lip 11, in a sealed condition, prevents gripping of the free lower edge 7*a* of the lid 2. After removal of the sealing lip 11 gripping the free lower edge 7*a* of the lid 2 is possible at the sealing position. According to the invention, such gripping of the free lower edge 7*a* of the lid 2 at the sealing position 12 after removal of the sealing lip 11 is possible in that the shape of the circumferential rib 8, and the depending edge 9 connecting thereto, at the sealing position 12 deviates from the shape thereof at the other circumferential positions. In each case, this deviating shape is such that the circumferential rib 8, throughout the circumference and hence also at the sealing position 12, extends adjacent the upper edge 5 of bucket 1, so that the stiffness of the bucket is substantially the same throughout the entire circumference thereof.

Figures 2A, 2B, 2C:
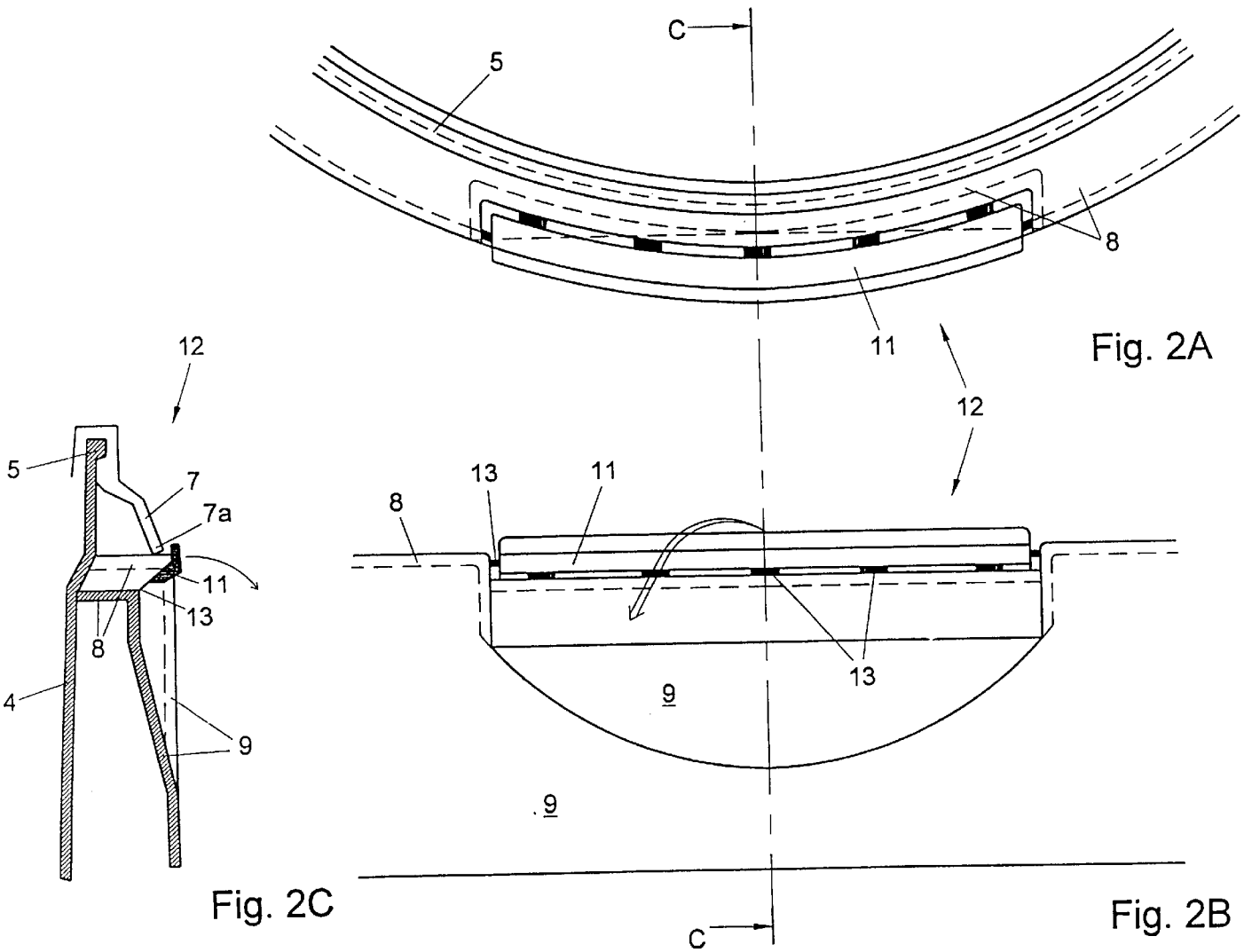
FIGS. 2A, 3A, 4A, 5A, 6A, 7A show a top plan view of a part of the circumferential edge of the various exemplary embodiments of buckets at the sealing position.
FIGS. 2B, 3B, 4B, 5B, 6B, 7B show a side elevation of a part of the circumferential edge of the various exemplary embodiments of buckets at the sealing position.
FIGS. 2C, 3C, 4C, 5C, 6C, 7C show a cross-sectional view along line C—C in the respective subfigures A and B.
Figures 3A, 3B, 3C:
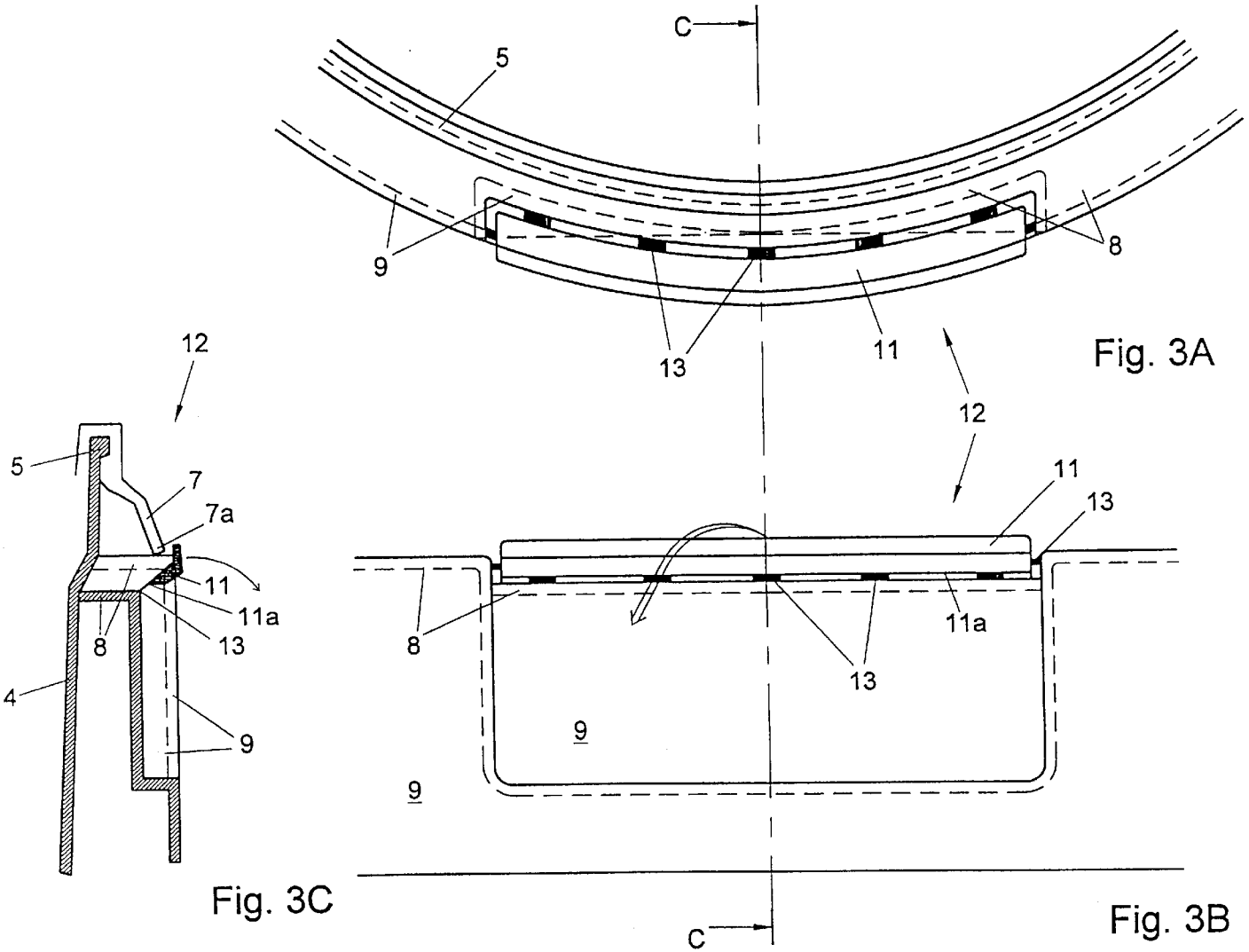
Figures 4A, 4B, 4C:
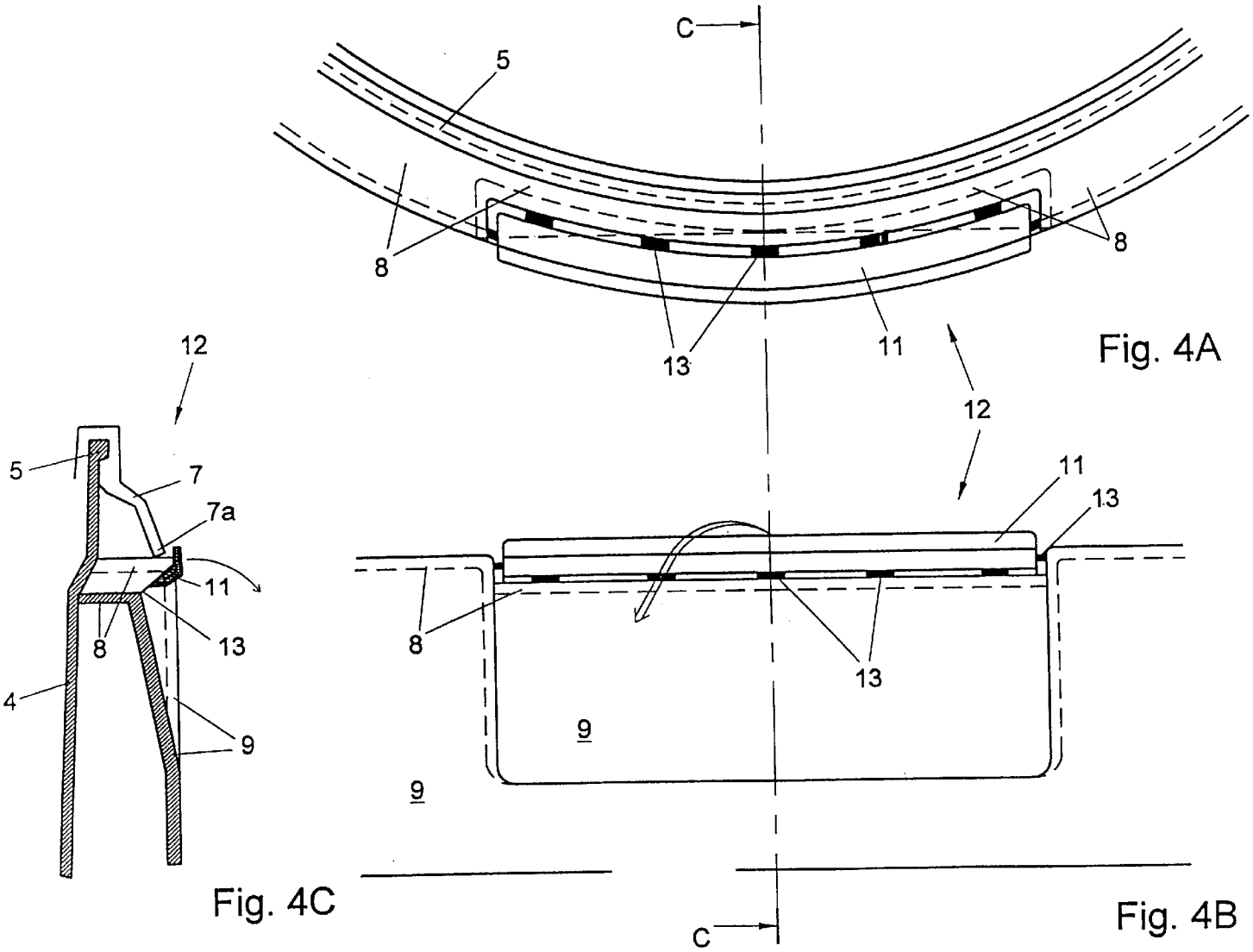

In the exemplary embodiments of FIGS. 2, 3 and 4 the deviating shape is characterized in that the circumferential rib 8 at the sealing position 12 is arranged somewhat lower than at the other circumferential positions and in that the depending edge 9 connecting to the circumferential rib 8 is situated somewhat closer to the sidewall 4 of the bucket 1 than it is at the other circumferential positions. The sealing lip 11, via a lower end 11*a* thereof, is detachably connected to the circumferential rib 8 at the transition between the circumferential rib 8 and the depending edge 9. In the exemplary embodiments shown in FIGS. 2–4 the detachable connection of the sealing lip 11 to the circumferential rib 8 is formed by breakable bridges 13 from plastic. It is also possible, however, for this connection to be formed by a very thin-walled plastic fleece 14 or by a combination of breakable bridges 13 with a thin-walled fleece.

Figure 5A:
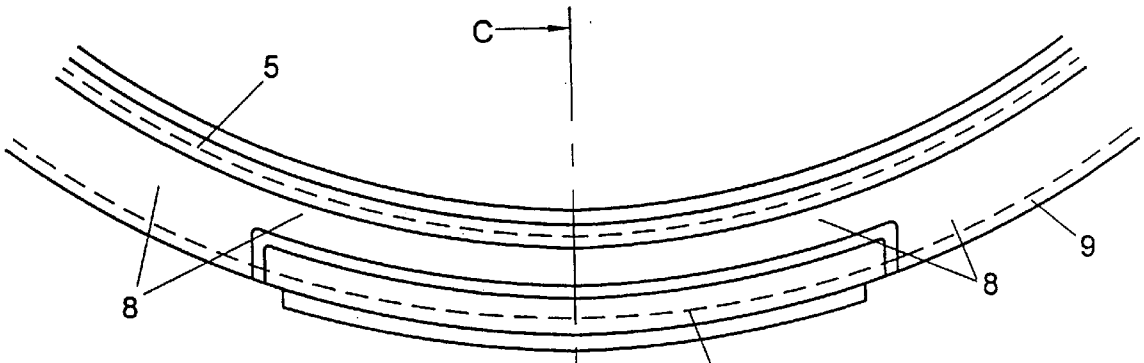
Figure 5B:
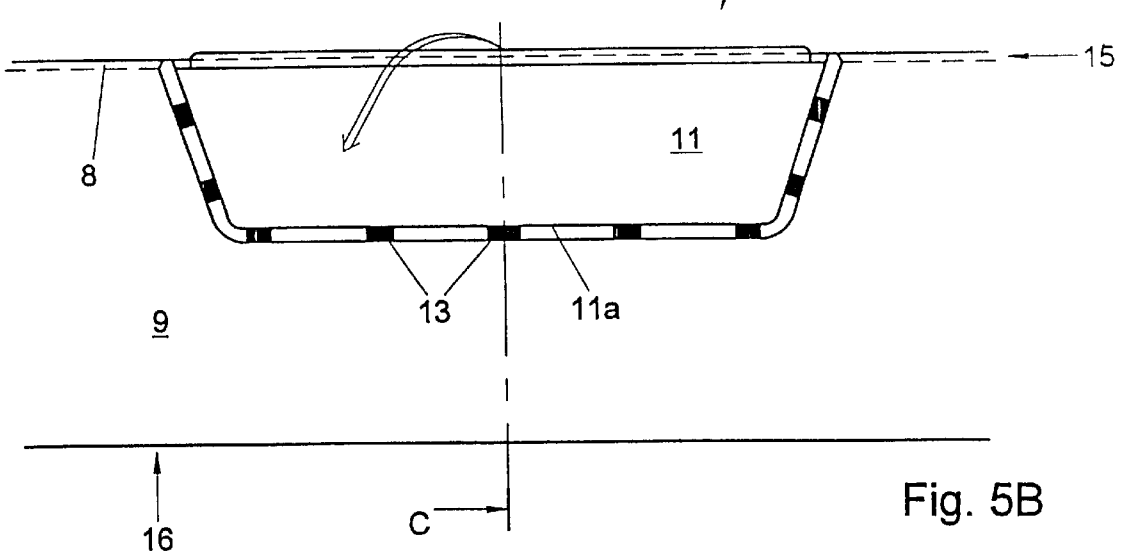
Figure 5C:
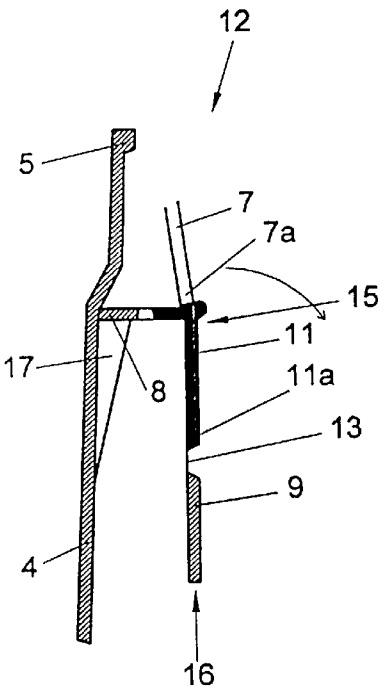
Figures 6A, 6B, 6C:
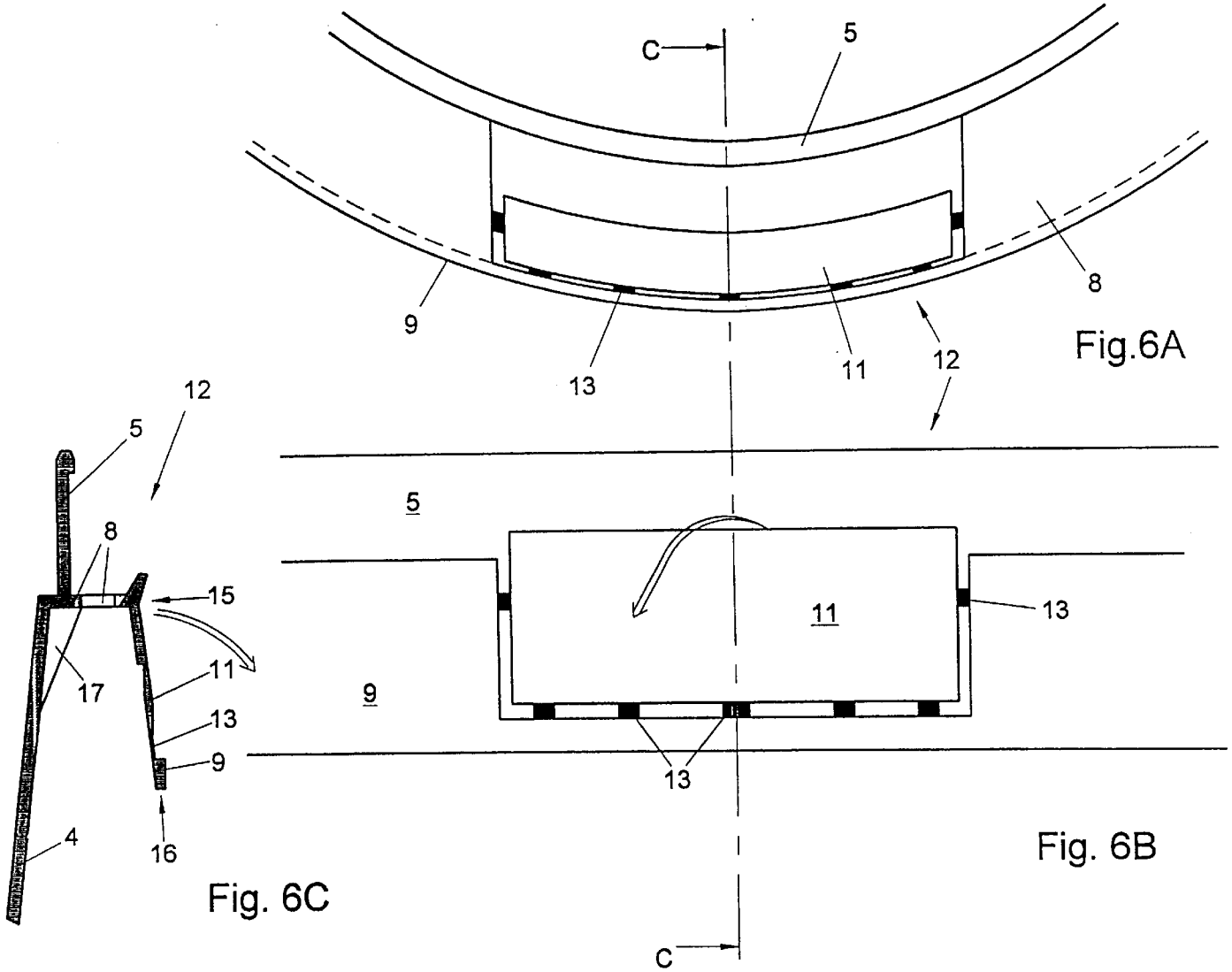
Figures 7A, 7B, 7C:
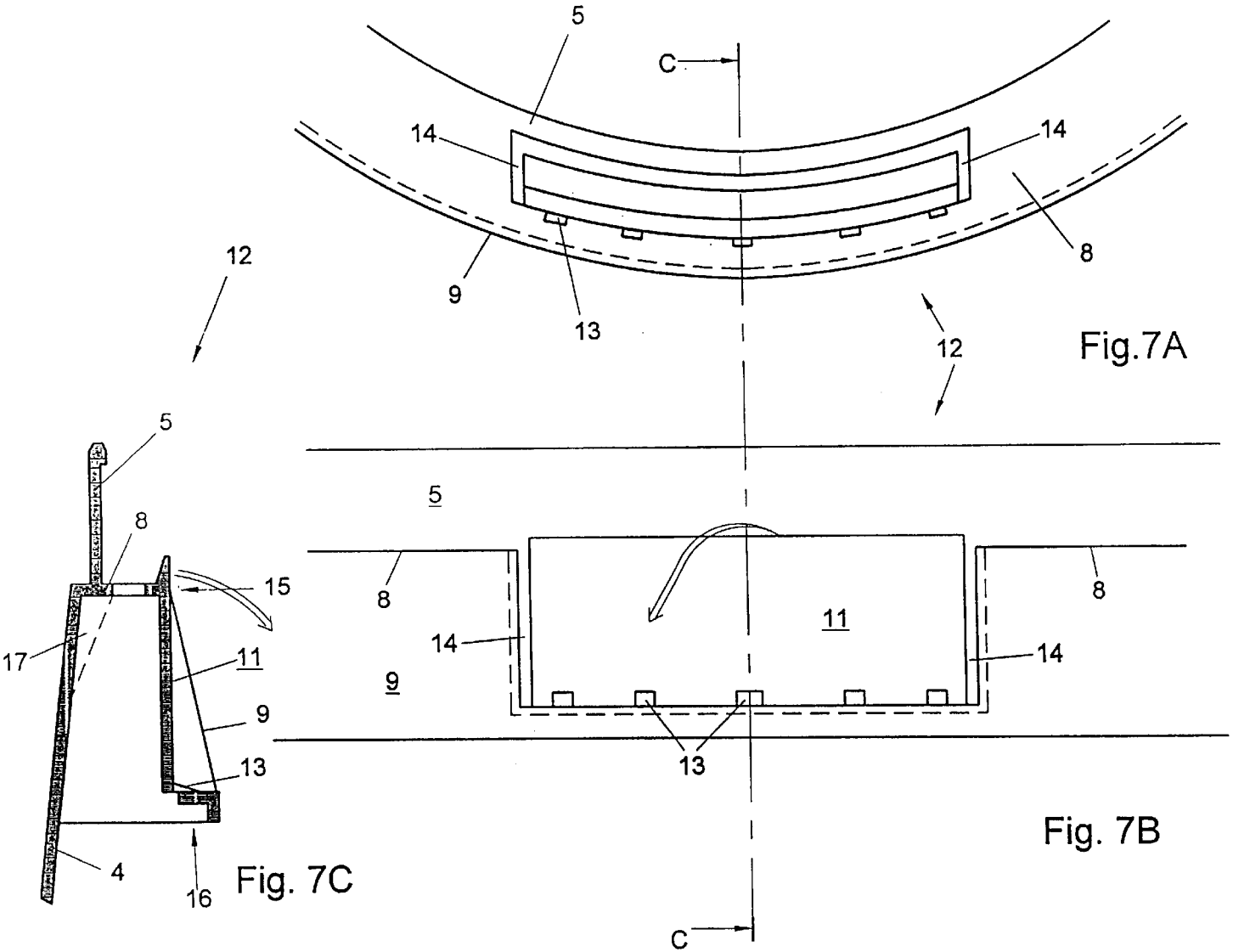

In the exemplary embodiments shown in FIGS. 5–7, the sealing lip 11 is basically formed from plastic walls 15, 16 which at the same time constitute the circumferential rib 8 and/or the depending edge 9. Here too, the connection between the sealing lip 11 and the circumferential rib 8 and/or depending edge 9 is constituted by breakable bridges 13 from plastic or by a very thin-walled plastic fleece 14 or by a combination thereof.

In all exemplary embodiments of the plastic bucket 1 shown, the sealing lip 11 is provided with a gripping edge 11*a* which is readily grippable for the purpose of breaking away the sealing lip 11.

In the exemplary embodiments of FIGS. 5, 6 and 7, circumferential rib 8, throughout the circumference of the bucket 1, is connected through strengthening-rib parts 17 with the or each sidewall 4 of the bucket 1, also at the sealing position 12. It goes without saying that such strengthening rib parts 17 could also be used in designing the type as shown in FIGS. 2–4.

A plastic bucket 1 with a particularly good stiffness is obtained when the shape of the circumferential rib 8, the depending edge 9 and the sealing lip 11 are such that after breaking away the sealing lip 11, at the sealing position 12 still a considerable stiffness-providing part of the circumferential rib 8 and the depending edge 9 remains behind. In this connection, the remaining part of the circumferential rib 8 at the sealing position 12 could, for instance, have a width which is at least 50% of the width of the circumferential rib 8 at the other circumferential positions, while the remaining part of the depending edge 9 at the sealing position 12 could, for instance, have a height which is at least 50% of the height of the depending edge 9 at the other circumferential positions.

It will be clear that the invention is not limited to the exemplary embodiments described, but that various modifications are possible within the scope of the invention. For instance, in FIG. 1 a bucket 1 with a handle 18 is depicted, which handle 18 is connected to the sidewall 4 of the bucket 2 via a hinge 19. However, the invention is also applicable with buckets not fitted with a handle 18. Further, in the present text, mention has been made of only one sealing lip 11 and one sealing position 12. It will be clear, however, that the invention is not limited thereto and that buckets with two or more sealing lips and sealing positions designed as described in detail hereinabove also fall within the scope of the invention.

We claim:

1. A plastic bucket provided with a lid, the bucket comprising a bottom wall and at least one sidewall terminates at an upper side of the bucket having only a single upper edge with a plurality of circumferential positions, the lid comprising a top wall and a depending circumferential apron by means of which the lid is clampable onto the single upper edge, the bucket comprising adjacent the upper edge a circumferential rib extending substantially perpendicularly to the bucket, which merges into a depending edge extending substantially parallel to the sidewall, the circumferential rib and the depending edge connecting thereto being provided with a profile to which connects a free lower edge of the depending circumferential apron of the lid, in a closed position of the lid, in such a manner that the free lower edge is not grippable for user, the bucket comprising a removable sealing lip which is located adjacent the circumferential rib and the depending edge connecting thereto, at a sealing position at one circumferential position, the sealing lip in a sealed condition preventing gripping of the free lower edge of the lid, while after removal of the sealing lip gripping the free lower edge of the lid at the sealing position is possible, characterized in that gripping the free lower edge of the lid at the sealing position after removal of the sealing lip is possible in that the shape of the circumferential rib, and the depending edge connecting thereto, at the sealing position deviates with respect to the shape thereof at the other circumferential positions, this deviating shape, however, being such, in each case, that the circumferential rib, throughout the circumference and hence also at the sealing position, extends adjacent the upper edge of the bucket, in such a manner that the stiffness of the bucket is substantially the same throughout the circumference thereof.

2. A plastic bucket according to claim 1, wherein the sealing lip is a plastic wall edge which at the same time constitute the circumferential rib or the depending edge, while the connection between the sealing lip and the circumferential rib or depending edge is constituted by breakable bridges from plastic or by a thin-walled plastic section of by a combination thereof.

3. A plastic bucket according to claim 1, wherein the sealing lip is provided with a gripping edge which is readily grippable for the purpose of breaking away the sealing lip.

4. A plastic bucket according to claim 1, wherein the circumferential rib, throughout the circumference of the bucket, is connected with the or each sidewall of the bucket via strengthening rib parts.

5. A plastic bucket according to claim 1, wherein at the sealing position the circumferential rib is disposed somewhat lower than at the other circumferential positions and the depending edge connecting to the circumferential rib is disposed somewhat closer to the sidewall of the bucket than at the other circumferential positions, while the sealing lip, via a lower end thereof, is detachable connected to the circumferential rib between the circumferential rib and the depending edge.

6. A plastic bucket according to claim 5, wherein the detachable connection of the sealing lip with the circumferential rib is formed by breakable bridges from plastic or by a thin-walled plastic section or by a combination thereof.

7. A plastic bucket according to claim 1, wherein the shape of the circumferential rib, the depending edge and the sealing rib are such that after breaking away the sealing lip at the sealing position, a considerable part of the circumferential rib and the depending edge remains behind to provide stiffness about the entire circumference of the bucket.

8. A plastic bucket according to claim 7, characterized in that after removing the sealing lip, the remaining part of the circumferential rib at the sealing position has a width which is at least 50% of a width of the circumferential rib at the other circumferential positions, while the remaining part of the depending edge at the sealing position has a height which is at least 50% of a height of the depending edge at the other circumferential positions.

* * * * *